US005476075A

United States Patent [19]

Doll et al.

[11] Patent Number: 5,476,075

[45] Date of Patent: Dec. 19, 1995

[54] HOLLOW ROCKER-ARM SHAFT FOR INTERNAL COMBUSTION ENGINES

[75] Inventors: Gerhard Doll, Esslingen; Helmut Seitz, Stuttgart; Volker Keck, Stuttgart; Walter Burböck, Stuttgart; Peter Linden, Wernau/N, all of Germany

[73] Assignee: Mercedes-Benz AG, Stuttgart, Germany

[21] Appl. No.: 306,135

[22] Filed: Sep. 14, 1994

[30] Foreign Application Priority Data

Sep. 16, 1993 [DE] Germany ..... 43 31 504.6

[51] Int. Cl.[6] ..... F01L 1/18; F01M 11/02

[52] U.S. Cl. ..... 123/90.36

[58] Field of Search ..... 123/90.33, 90.36, 123/90.39; 464/179, 183

[56] References Cited

U.S. PATENT DOCUMENTS

| | | | |
|---|---|---|---|
| 4,615,310 | 10/1986 | Umeha et al. | 123/90.33 |
| 4,662,323 | 5/1987 | Moriya | 123/90.36 |
| 4,807,574 | 2/1989 | Shibata et al. | 123/90.36 |
| 5,010,857 | 4/1991 | Hempelmann et al. | 123/90.39 |
| 5,125,373 | 6/1992 | Yamada et al. | 123/90.36 |

FOREIGN PATENT DOCUMENTS

| | | |
|---|---|---|
| 0052077 | 5/1982 | European Pat. Off. . |
| 0259106 | 3/1988 | European Pat. Off. . |
| 1263414 | 2/1972 | United Kingdom . |
| 1288130 | 9/1972 | United Kingdom . |
| 2268547 | 1/1994 | United Kingdom . |

*Primary Examiner*—Weilun Lo
*Attorney, Agent, or Firm*—Klaus J. Bach

[57] ABSTRACT

The invention resides in a hollow rocker-arm shaft with multiple internal passages for an internal combustion engine which rocker-arm shaft consists of two shell sections forming circular segments which are welded together by a weld seam extending along the longitudinal edges of the circular segments and at least one dividing wall extends through the interior of the hollow shaft between the weld seams and divides the interior of the hollow shaft into at least two passages.

9 Claims, 2 Drawing Sheets

HOLLOW ROCKER-ARM SHAFT FOR INTERNAL COMBUSTION ENGINES

BACKGROUND OF THE INVENTION

The invention relates to a hollow rocker-arm shaft for internal combustion engines and a method of manufacturing such a rocker-arm shaft which has at least two longitudinal passages for carrying control and lubricating fluid.

A hollow rocker-arm shaft is known from EP 0 259 106 B1, FIGS. 9, 10 wherein a longitudinal internal web forms separate passages for supplying lubricating oil to valve actuation means and for supplying control oil to control means.

The interior of the hollow rocker-arm shaft is sub-divided by longitudinal webs into at least three fluid-carrying chambers. The longitudinal webs are firmly connected to the rocker-arm shaft.

It is the principal object of the present invention to optimize, in terms of production efforts and expenditures, the manufacture of rocker-arm shafts which include at least two passages and consist preferably of sheet steel.

SUMMARY OF THE INVENTION

The invention resides in a hollow rocker-arm shaft with multiple internal passages for an internal combustion engine which rocker-arm shaft consists of two shell sections forming circular segments which are welded together by a weld seam extending along the longitudinal edges of the circular segments. At least one dividing wall extends through the interior of the hollow shaft between the weld seams and divides the interior of the hollow shaft into at least two passages.

Because the shells of the two-part rocker-arm shaft which are preferably manufactured by drawing are placed together and, after a longitudinal web has been placed between them, are simultaneously welded to one another and to the web, the hollow rocker-arm shaft is simple to manufacture and furthermore is of high strength and stability. In addition, the total weight is minimized.

If the two shells have ramp-like humps where the webs are connected, damage to the separating web in the hollow space of the rocker-arm shaft is avoided during welding of the shells.

The invention will be described in greater detail below on the basis of various embodiments shown in the drawings.

DESCRIPTION OF THE PREFERRED EMBODIMENTS

Figure 1:
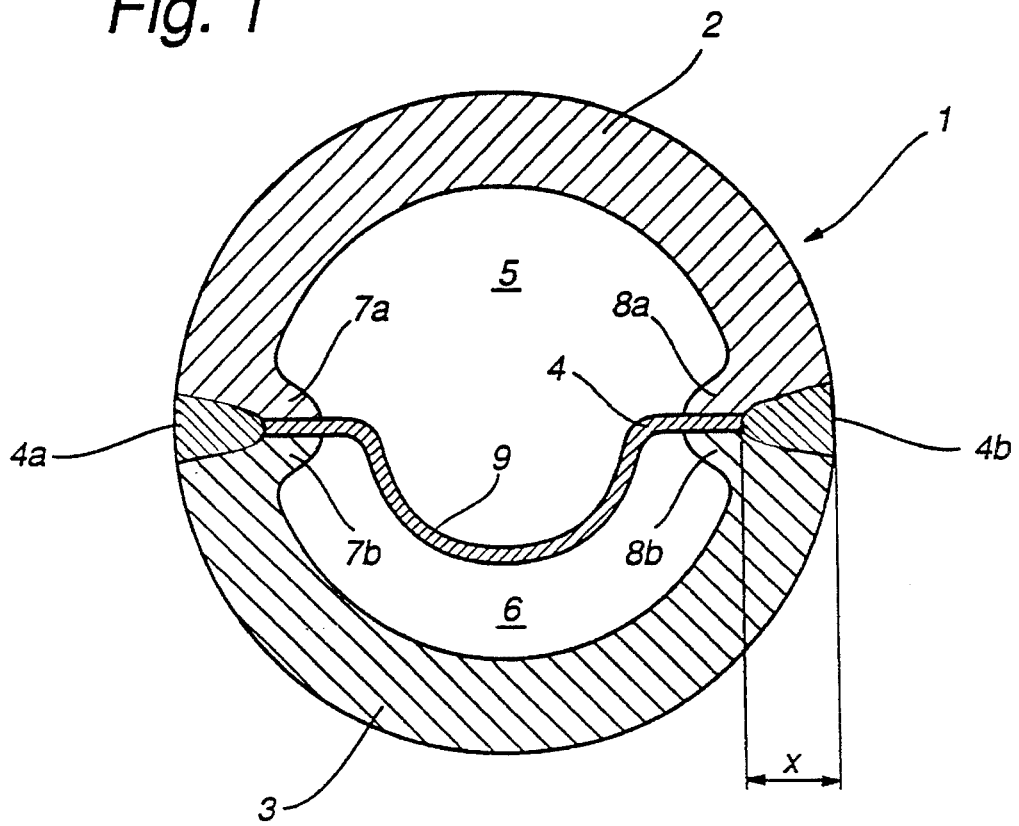
FIG. 1 shows, in cross-section, a hollow rocker-arm shaft with a longitudinal separating web providing for two passages.

FIG. 1 shows a hollow circular, two-part rocker-arm shaft 1 which consists of two equally large, drawn shells 2, 3 or tube halves. Before the shells 2, 3 are placed one on the other, a longitudinal web 4 extending over the full length and diameter of the rocker-arm shaft 1 is placed between them as a separating wall in order to form two passages 5, 6. The thin-walled longitudinal web 4, which consists of a steel sheet, has, for example, a web thickness of 0.5 mm and has a width such that its edges 4*a* and 4*b* are disposed flush with the outside of the rocker-arm shaft 1. The two shells 2, 3, which are of the same construction, are provided with ramp-shaped humps 7*a*, 7*b* and 8*a*, 8*b* at their connection locations.

The components—shell 2, longitudinal web 4 and shell 3—disposed on one another are sealingly welded together by a welding robot (not represented) using laser welding. The weld seam is applied with a weld depth corresponding to the wall thickness of the rocker-arm shaft 1. The arrangement of the ramp-type humps 7*a*, 7*b*; 8*a*, 8*b*, which have their maximum elevation adjacent the longitudinal web 4, insures that there is no danger of welding through to the exposed part of the longitudinal web 4 protruding into the interior of the rocker-arm shaft. The longitudinal web 4 therefore remains undamaged during the welding step.

The fluid-carrying passages 5, 6 should generally have different cross-sections. The longitudinal web 4 is therefore given a gutter-type configuration or is shaped to provide a trough 9 extending parallel to the rocker-arm shaft 1.

Figure 2:
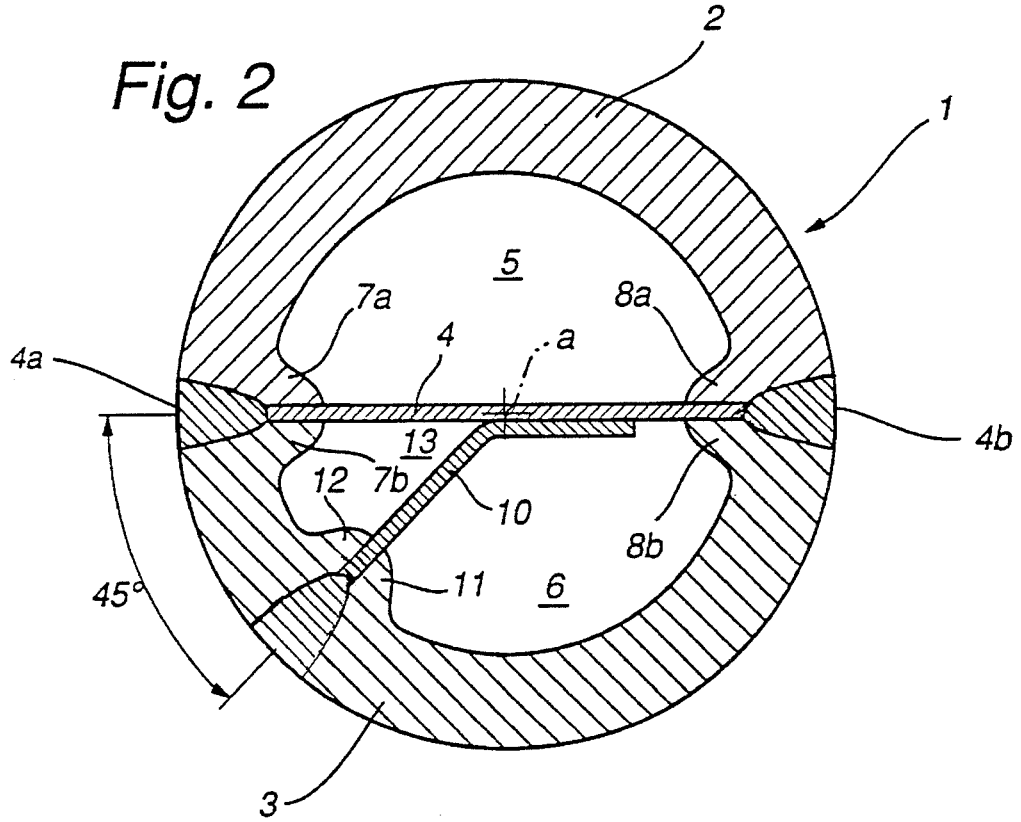
FIG. 2 shows, in cross-section, an embodiment with three passages.

The rocker-arm shaft 1 of FIG. 2 differs from that of FIG. 1 only by the three-duct embodiment, in which the longitudinal web 4 consists of a continuous flat steel sheet to which an angled dividing wall 10 is sealingly connected so as to define a Y-shape with the longitudinal web 4. At the shaft center a, the dividing wall 10 extends from the longitudinal web 4 at an angle of approximately 45° and ends in a groove 11 of a hump 12 formed in the lower shell 3. The dividing wall 10 is inserted firmly into the groove 11, so that it seals and delimits a third passage which is designated by the numeral 13. The dividing wall 10 can, alternatively, be firmly connected to the shell 3 by laser welding.

Figure 3:
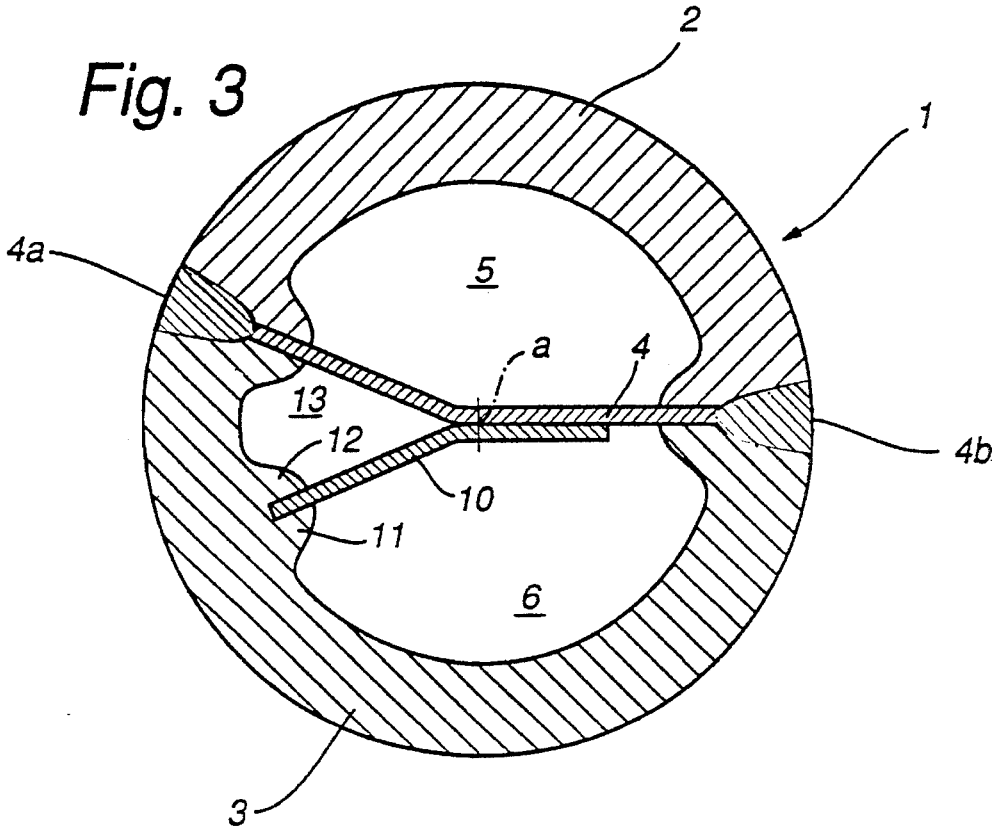
FIG. 3 shows, in cross-section, another embodiment with three passages.

The rocker-arm shaft 1 of FIG. 3 differs from the embodiments of FIGS. 1 and 2 by the differently sized shells 2, 3 because the longitudinal web 4 is angled and forms, with the angled dividing wall 10, a "V" providing, as a result, three passages.

Figure 4:
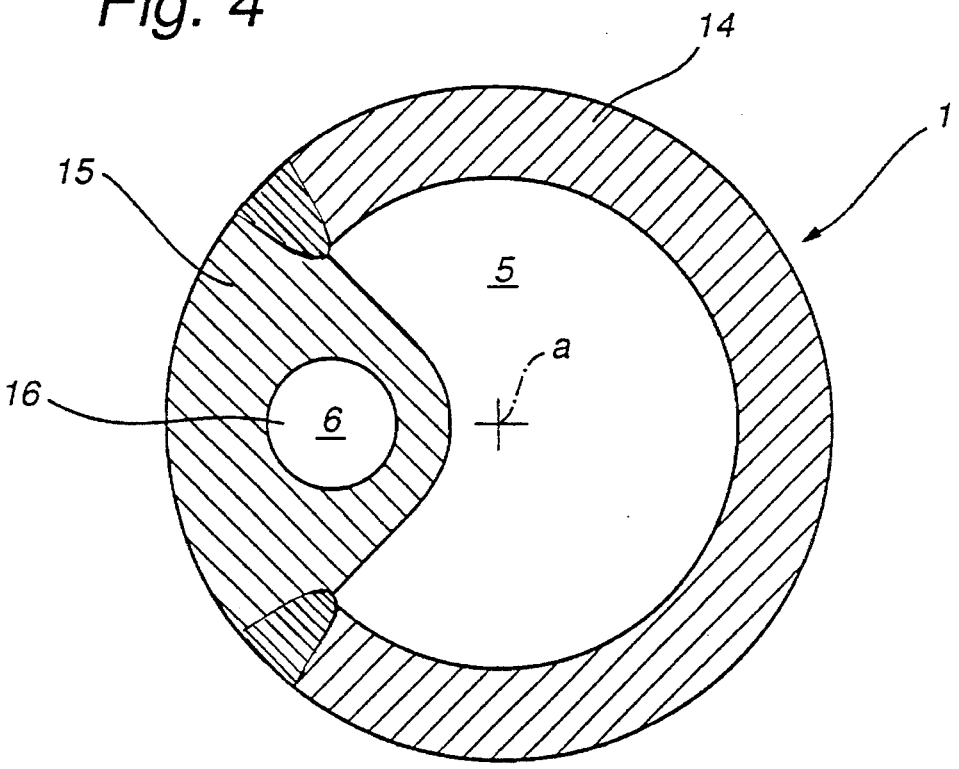
FIG. 4 shows, in cross-section, a further embodiment with two passages.

FIG. 4 shows a hollow rocker-arm shaft 1 with two chambers. To form this rocker-arm shaft 1, a flat plate is rolled into a circular segment 14 with a cross-sectional shape similar to a sickle and providing a single shell. A wedge-shaped insert 15 is fitted into the gap between the ends of the circular segment 14 and welded thereto so that a circular rocker-arm shaft 1 is produced after the circular segment 14 and the insert piece 15 protrudes been welded together. The wedge-shaped insert piece 15 protrudes approximately as far as the shaft center "a" of the rocker-arm shaft 1 and contains a continuous opening 16 forming a fluid-carrying passage.

What is claimed is:

1. A hollow rocker-arm shaft with multiple internal passages for an internal combustion engine, said shaft comprising two shell sections forming circular segments connected together along their longitudinal edges by two weld seams so as to form a circular hollow shaft and at least one wall structure extending between said weld seams through the interior of said circular hollow shaft so as to divide the interior of said circular hollow shaft into at least two passages.

2. A rocker-arm shaft according to claim 1, wherein said wall structure is a longitudinal web disposed between the two shell sections and welded together with said shell sections to form said passages.

3. A rocker-arm shaft according to claim 2, wherein at their connections, the two shell sections of the rocker-arm shaft have ramp-type humps protruding into the interior of the shaft and engaging therebetween said longitudinal web.

4. A rocker-arm shaft according to claim 3, wherein said two shell sections are two equally large semicircular shells and the longitudinal web is shaped so as to form a trough extending parallel to the rocker-arm shaft.

5. A rocker-arm shaft according to claim 4, wherein said longitudinal web is a flat sheet and an angled dividing wall is sealingly connected to the longitudinal web such that the longitudinal web and the dividing wall are disposed in the shape of a "Y" and jointly form a further passage, the free end of the dividing wall being sealingly connected to one of the two equally large shells of the rocker-arm shaft.

6. A rocker-arm shaft according to claim 3, wherein said two shell sections are sized differently and said longitudinal web is angled and an angled dividing wall is sealingly connected to said longitudinal web so as to provide a Y-shaped structure, the dividing wall being firmly connected at its free end to one of the two differently sized shells of the rocker-arm shaft so as to form together with the longitudinal web a further passage.

7. A rocker-arm shaft according to claim 5, wherein the free end of the dividing wall is sealingly received in a groove of a hump formed on one of the two shells of the rocker-arm shaft.

8. A rocker-arm shaft according to claim 6, wherein the free end of the dividing wall is sealingly received in a groove of a hump formed on one of the two shells of the rocker-arm shaft.

9. A rocker-arm shaft according to claim 1, wherein one of said shell sections has a circular extent greater than 180° so as to have a sickle-like cross-sectional shape with a gap between the longitudinal edges of said one shell section, and the other shell section is a hollow wedge-shaped structure having a circular section fitted into said gap and welded to the longitudinal edges of said one shell section and extending into the space surrounded by said one shell section so as to form a circular shaft structure including two longitudinal passages.

* * * * *